US007091053B2

(12) United States Patent
Yang

(10) Patent No.: US 7,091,053 B2
(45) Date of Patent: Aug. 15, 2006

(54) IN-LINE WAFER SURFACE MAPPING

(75) Inventor: Wan-Cheng Yang, Jhubei (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 124 days.

(21) Appl. No.: 10/810,533

(22) Filed: Mar. 26, 2004

(65) Prior Publication Data

US 2005/0227587 A1 Oct. 13, 2005

(51) Int. Cl.
*H01L 21/00* (2006.01)
*B24B 51/00* (2006.01)

(52) U.S. Cl. ..... 438/16; 451/6

(58) Field of Classification Search ..... 451/5, 451/6; 438/16

See application file for complete search history.

(56) References Cited

U.S. PATENT DOCUMENTS 6,485,354 B1 * 11/2002 Wolf ..... 451/6
6,568,989 B1 * 5/2003 Molnar ..... 451/5
2005/0026542 A1 * 2/2005 Battal et al. ..... 451/5

* cited by examiner

*Primary Examiner*—Evan Pert
(74) *Attorney, Agent, or Firm*—Duane Morris LLP

(57) ABSTRACT

A method and apparatus for the topographical profiling of a raw substrate is carried out during in-line processing of the substrate during which additional films and structures have been formed over the raw substrate surface. The method includes forming a dielectric film over the substrate surface and forming a metal film over the dielectric film. The structure is polished and monitored during various stages of the polishing operation. An interferometer is used to monitor the surface being polished and to distinguish between regions where metal remains and regions in which metal has been removed and the underlying dielectric material exposed. Topographical data, such as a substrate map, is generated by monitoring the time at which the metal film is removed from various spatial locations across the substrate. The substrate map may be generated during polishing, for in-line monitoring.

24 Claims, 5 Drawing Sheets

IN-LINE WAFER SURFACE MAPPING

FIELD OF THE INVENTION

The present invention relates, most generally, to semiconductor devices and methods for forming the same. More particularly, the present invention relates to a method and apparatus for mapping raw substrate topography during in-line processing.

BACKGROUND

Semiconductor devices such as integrated circuits and the like, are formed by performing a series of processing operations upon a substrate to form accurately sized and precisely aligned device features. The device features are formed from various conductive and dielectric films that are formed on the substrate. The processing operations include multiple photolithographic patterning processes used to pattern the various conductive and dielectric films and also to define regions in the films or the substrate into which various impurities will be introduced. It is critical to accurately define the various device features so that they are accurately sized, positioned and aligned to tight tolerances.

In each of the multiple photolithographic patterning processes, it is critical to project the photolithographic image onto a focal plane that is at a known location such as the substrate surface. If the substrate surface is not at the expected location, pattern distortion and/or misalignment may result. If the substrate surface is not uniformly level, then such pattern distortion and/or misalignment may occur at various locations across the substrate. Many other of the processing operations used to form the various device features are similarly sensitive to the position of the substrate surface. In summary, non-uniformities in the substrate surface can translate to improperly sized, positioned and aligned device features throughout the substrate. This may result in device characteristics that fail and/or vary unacceptably across the substrate.

It is therefore important for the substrate surface to be uniformly level and likewise important to be able to monitor the topographical uniformity of the substrate surface. This is especially true as device feature sizes shrink into the nanometer regime while substrate sizes increase to 12 inch diameters or greater, increasing the likelihood that substrate surface non-uniformities will result in device feature defects. It would be especially useful to be able to obtain such topographical data on the raw substrate, during the in-line processing of the substrate and responsive to the detection of unacceptable or non-uniform device parameters or characteristics. Such timely information would be useful in establishing a correlation between these parameters or characteristics, and the substrate topography, or in determining another root cause of the problem. The acquisition of in-line surface topographical data would also be useful in determining the degree of substrate surface non-uniformity that is acceptable for production use. This applies to the various substrates upon which semiconductor devices are formed such as silicon wafers, gallium arsenide wafers, sapphire wafers, and other substrates.

FIGS. 1A and 1B are exemplary scans of raw substrate surface profiles showing a substrate with an acceptably level profile in FIG. 1A and an unacceptable substrate with extreme undulations shown in FIG. 1B. While "acceptable" versus "unacceptable" is an arbitrary and relative designation, it is apparent that the substrate depicted graphically in FIG. 1A has a relatively uniform surface and also that the substrate depicted graphically in FIG. 1B exhibits relatively poor uniformity. Referring to the substrate depicted graphically in FIG. 1B, it would appear that patterning and other inconsistencies will be produced between devices and features formed in the relatively low areas 101 and those formed in the relatively high areas 103 of such a substrate.

According to existing technological capabilities, the topography of a substrate is detected and mapped when the substrate is in raw form, i.e., prior to the various manufacturing processing operations carried out upon the substrate. It would therefore be useful to provide a method for mapping the topography of the raw substrate while in-line processing operations are being carried out on the substrate especially since anomalies or non-uniformities are commonly detected during the in-line formation of the devices. The generation of such in-line mapping data can be useful in determining root cause effects of the various anomalies and in instituting immediate fixes and/or other process controls.

SUMMARY OF THE INVENTION

To achieve these and other objects, and in view of its purposes, the present invention addresses the shortcomings of conventional technology and provides a method and apparatus for generating topographical data regarding a raw substrate during the in-line processing of the substrate.

In one exemplary embodiment, the present invention provides a method for mapping surface topography of a substrate. The method comprises forming a non-metallic film over a substrate and a metal film over the non-metallic film. The method further comprises polishing to remove at least a portion of the metal film and distinguishing first regions in which the metal remains from second regions in which the metal has been removed and the non-metallic film exposed. In another exemplary embodiment, the method may be used to distinguish a reflective film from a non-reflective film.

In another exemplary embodiment, the present invention provides an apparatus for in-line monitoring of surface topography of a substrate. The apparatus includes a body for receiving a substrate thereon, polishing means for polishing a surface of the substrate, and detecting means for detecting the presence or absence of a reflective film, at a plurality of locations on the surface, during the polishing operation.

BRIEF DESCRIPTION OF THE DRAWING

The present invention is best understood from the following detailed description when read in conjunction with the accompanying drawing. It is emphasized that, according to common practice, the various features of the drawing are not necessarily to scale. On the contrary, the dimensions of the various features are arbitrarily expanded or reduced for clarity. Like numerals denote like features throughout the specification and drawing. Included are the following figures.

DETAILED DESCRIPTION

Figure 2A:
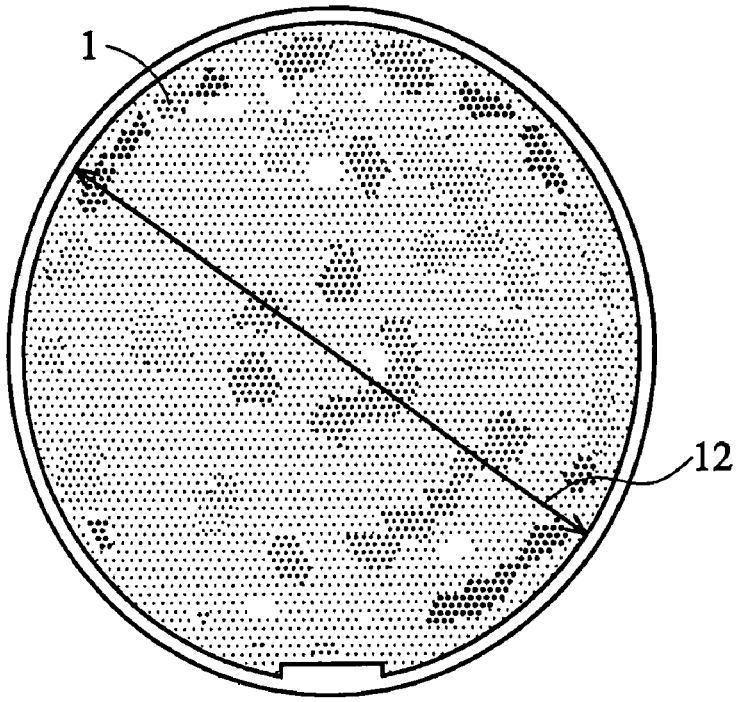
FIG. 2 is a plan view of an exemplary substrate with an uneven substrate surface and an accompanying topographical plot that is representative of the uneven surface.
Figure 2B:
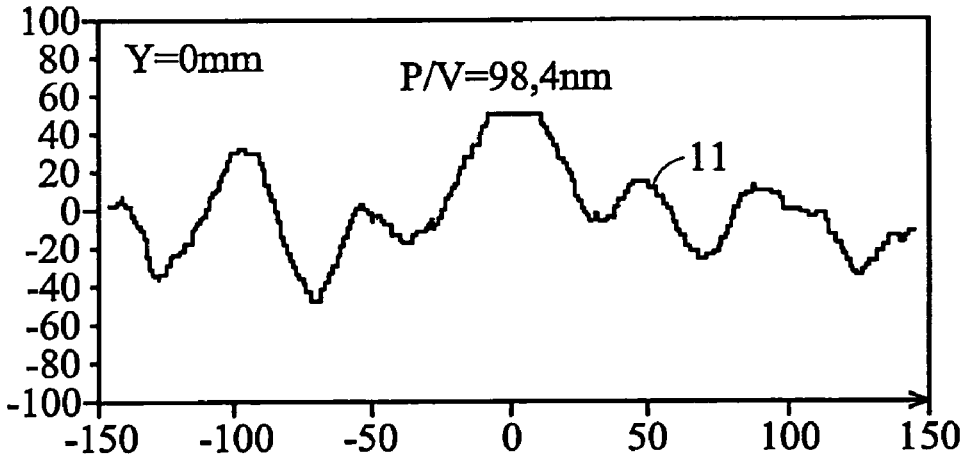

FIG. 2 is a plan view that illustrates an uneven substrate surface of an exemplary substrate. Alternatively stated, the substrate surface has a non-uniform topography. The topography of the uneven surface is represented by plot 11 which is taken along arbitrary direction 12 in the exemplary embodiment. The higher and lower sections in plot 11 correspond to raised and depressed sections of substrate 1, respectively, and are exemplary only. Such information is conventionally gathered when substrate 1 is in raw form and prior to any of the processing operations have been performed upon the substrate 1. A number of plots 11 may be taken at various locations and in various directions along the surface of substrate 1 to provide for the topographical mapping of the substrate.

Figure 3:
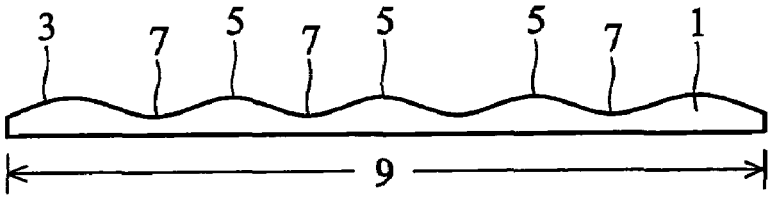
FIG. 3 is a cross-sectional view of an exemplary substrate with an uneven substrate surface.

FIG. 3 is a cross-sectional view of exemplary substrate 1. Substrate 1 may be any of various substrates such as an N- or P-type silicon substrate, a gallium arsenide substrate, a sapphire substrate or other substrates commonly used in the semiconductor manufacturing industry. Such substrates upon which semiconductor devices are to be formed, are also referred to as wafers in the semiconductor manufacturing industry. Substrate 1 includes substrate surface 3 upon which semiconductor devices are to be formed. Substrate surface 3 is uneven and includes raised sections 5 and depressed sections 7. As shown in FIG. 2, substrate 1 is generally round and may include a diameter 9 that may be 4, 6, 8, 10 or 12 inches or greater, in various exemplary embodiments.

Figure 4:
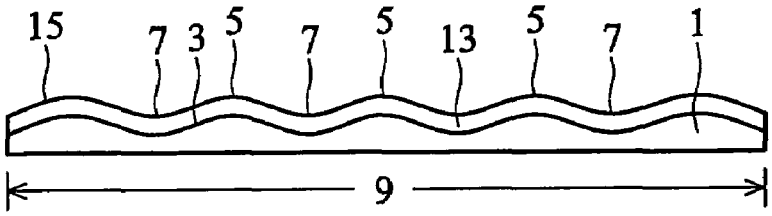
FIG. 4 is a cross-sectional view showing the exemplary substrate in FIG. 3 after a film has been formed over the substrate.

FIG. 4 shows the structure shown in FIG. 3, after layer 13 has been formed over surface 3 of substrate 1. Layer 13 may consist of a single film or a plurality of films and one or more patterned layers may be included within layer 13. For example, layer 13 may represent an interlevel dielectric (ILD) that covers a patterned polysilicon or other film that forms interconnect leads. Layer 13 may also represent a film or plurality of films that have been polished using conventional methods. Such conventional polishing methods planarize structures locally but not necessarily globally over the surface of substrate 1. As such, upper surface 15 of layer 13 may generally include the same contours as original substrate surface 3 while local areas of upper surface 15 are substantially planarized.

Figure 5:
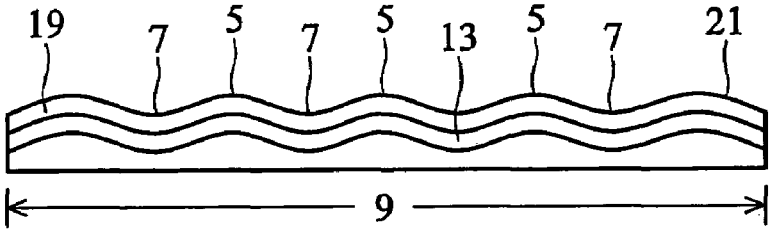
FIG. 5 is a cross-sectional view showing a non-metallic film formed over the structure shown in FIG. 4.

FIG. 5 shows the structure in FIG. 4 after non-metallic layer 19 has been formed over upper surface 15. Non-metallic layer 19 is a non-reflective, light absorbing material and may be a dielectric layer such as an intermetal dielectric (IMD). Various suitable non-reflective materials may be used for non-metallic film 19 which includes top surface 21. Various suitable dielectric materials may be used in the exemplary embodiment in which non-metallic film 19 is an IMD. While various films such as non-metallic layer 19 may themselves include non-uniformities, such non-uniformities are typically within the range of hundreds or thousands of angstroms whereas the undulations in the substrate surface topography may be several microns. As such, the typical non-uniformities associated with non-metallic film 19 (or other formed films) will generally be negligible when compared to differences in the substrate surface topography.

Figure 6:
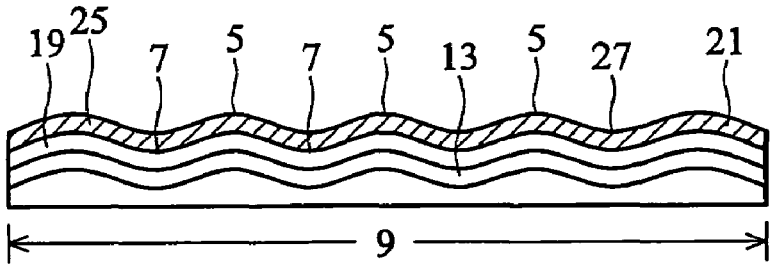
FIG. 6 is a cross-sectional view showing a metal film formed over the structure shown in FIG. 5 after.

FIG. 6 shows the structure in FIG. 5 after a metal film 25 has been formed over non-metallic film 19. Metal film 25 may be copper or various other suitable conductive materials. In an exemplary production embodiment, non-metallic film 19 may be an IMD and, on a local scale, metal film 25 may also extend within trenches, vias, or other openings formed within this IMD, but these are not shown as they are of negligible dimension, e.g. in the micron or even nanometer range, in comparison to substrate diameter 9 which is several inches. Metal films are reflective and therefore the arrangement of metal film 25 formed over non-metallic film 19 may be alternatively considered a reflective film 25 formed over non-metallic film 19.

The substrate shown in FIG. 6 is then polished, for example, by using a conventional CMP (chemical mechanical polishing) operation. More particularly, surface 27 of metal film 25 is polished and locally planarized. In an exemplary embodiment in which non-metallic film 19 is an intermetal dielectric, such a polishing operation may be used to remove metal film 25 from over top surface 21 of the intermetal dielectric while leaving metal within the aforementioned trenches, vias, and other openings formed in the intermetal dielectric to produce interconnect features.

Figure 7:
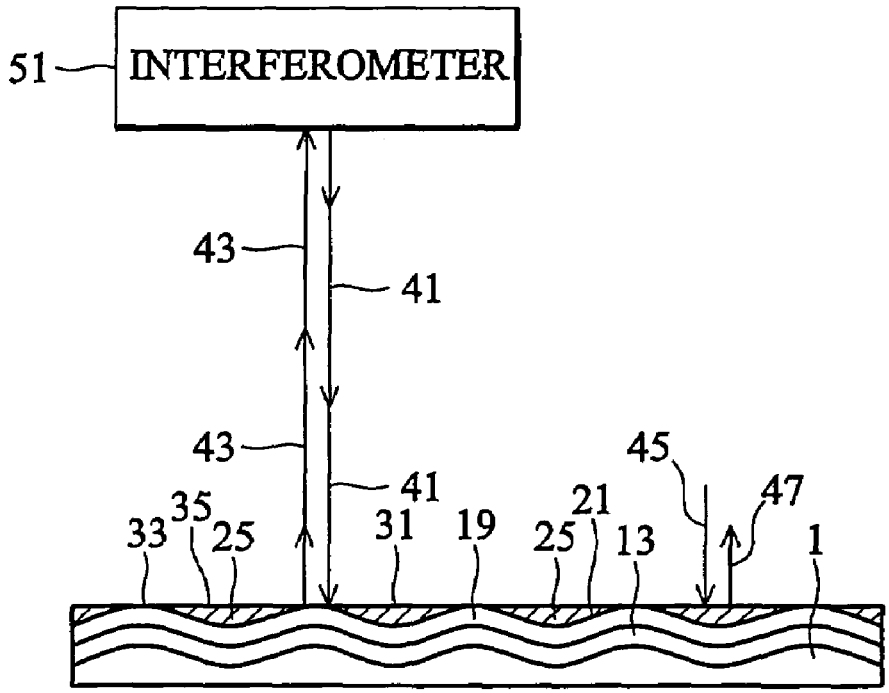
FIG. 7 is a cross-sectional view showing the exemplary substrate shown in FIG. 6 during a subsequent polishing operation according to the present invention.

FIG. 7 shows the substrate during an exemplary stage in the polishing process. It can be seen that portions of metal film 25 have been removed in regions 33 in which top surface 21 of non-metallic film 19 is exposed. During the polishing operation, polished surface 31 is produced. Polished surface 31 also includes portions 35 in which metal film 25 still remains. It can be seen that metal remains in low topographical areas of substrate 1 (regions 7 in FIG. 3) and is first removed from relatively high topographical areas of substrate 1 (regions 5 in FIG. 3). The polishing process may be continued until essentially all of metal film 25 that is above top surface 21 of non-metallic film 19, is removed.

The present invention provides for an optical profiling technique to be carried out during the polishing process. The optical profiling technique of the present invention may be carried out at the instant of time illustrated in FIG. 7, for example. The optical profiling technique of the present invention monitors polished surface 31 and distinguishes regions in which metal remains, from other regions in which the metal has been removed and the non-reflective non-metallic film exposed. Metallic (reflective) areas are thereby spatially distinguished from non-metallic (light absorbing) areas, thereby providing information on the topography of the raw substrate 1.

An optical beam is directed toward the substrate, more particularly, toward upper polished surface 31 and is used in detecting the presence or absence of metal film 25 which is reflective. An interferometer such as interferometer 51 may be used, but other arrangements for directing a light beam to polished surface 31 may be used in other exemplary embodiments. At location 33 where non-metallic film 19 is exposed and metal film 25 has been removed, beam 41 extends into non-reflective, non-metallic film 19 and provides refracted beam 43 that may be directed back to, and sensed by, interferometer 51. In areas such as region 35, in which metal remains, beam 45 is directed to surface 31 by an interferometer (not shown) which may be the same interferometer that produces beam 41. At polished surface 31, beam 45 is reflected to produce reflected beam 47 and a conventional interferometer does not detect a change in the optical signal. The interferometer distinguishes refracted beam 43, indicative of an exposed region of non-reflective, non-metallic material, from reflected beam 47, indicative of a metal region. Beams 41 and 43 are representative of optical beams directed to the substrate. In an exemplary embodiment, a number of beams may be directed toward multiple spatially separated locations over surface 31 and in another exemplary embodiment, a single beam may scan the surface. At a plurality of spatially separated locations along the substrate surface, the interferometer monitors the beam directed to the substrate surface and determines whether metal is still present or has been removed. Multiple scans along various directions may be made to provide a sample sufficient to map the entire substrate surface.

Figure 1A:
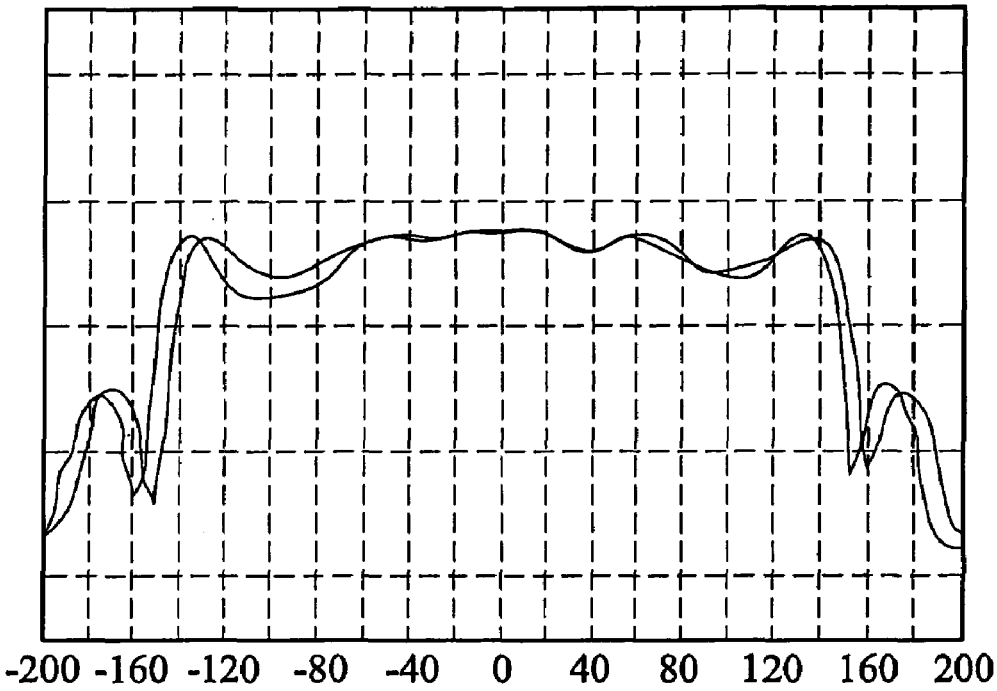
FIGS. 1A and 1B are plots of substrate topography for acceptable and unacceptable substrates respectively.
Figure 1B:
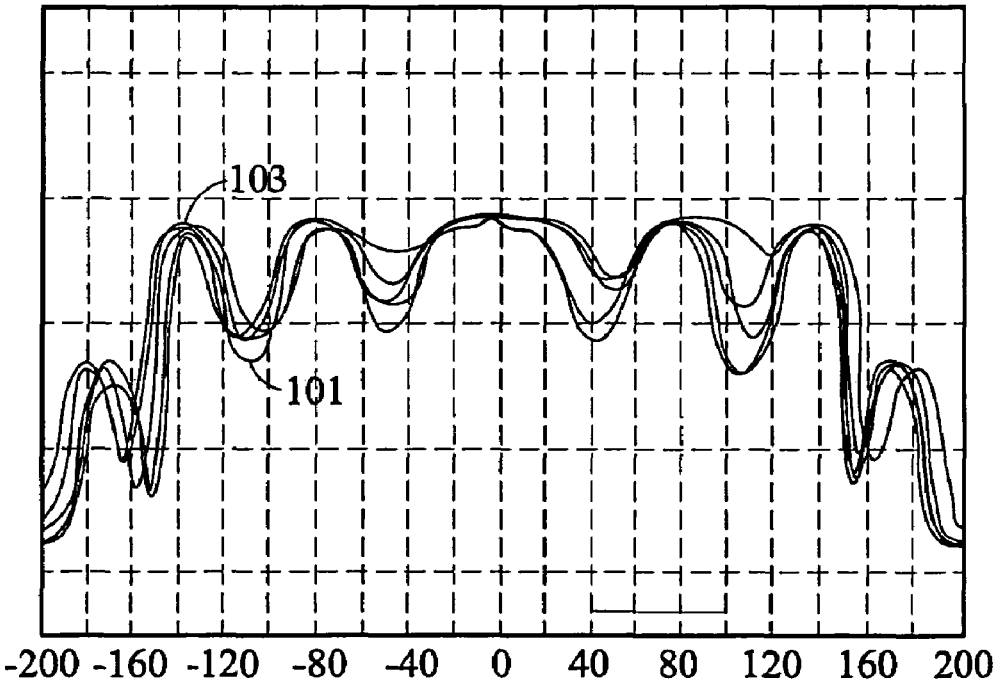

The optical profiling technique of the present invention may be repeated at various times during the polishing process, for example, before or after the exemplary instant of time illustrated in FIG. 7. The optical profiling technique of the present invention may be carried out periodically or substantially continuously throughout the polishing operation, that is, a plurality of scans may be made at closely spaced time intervals during the polishing operation. When a plurality of such samplings are done over time and over the substrate surface, a two-dimensional scan of the substrate surface may be produced and displayed such as shown in FIGS. 1A and 1B. Alternatively, a three dimensional topographical map of the substrate surface is achievable based on the locations and relative times in which top surface 21 of non-metallic film 19 is exposed. Regions where top surface 21 of non-metallic film 19 is first exposed, generally correspond to raised sections 5 such as shown in FIG. 3 and regions in which metal is last removed correspond to depressed section 7, such as shown in FIG. 3.

Figure 8:
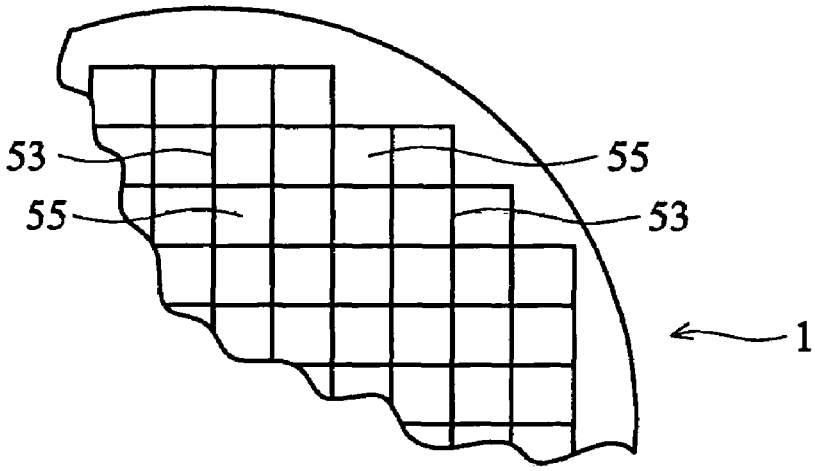
FIG. 8 is a partial plan view of a substrate surface containing semiconductor devices and scribe lines.

In one exemplary embodiment, the interferometer may monitor the optical signals at scribe line locations along the substrate surface of a production wafer. Scribe lines 53 bound and separate semiconductor devices 55 on substrate 1, as shown in FIG. 8. In other exemplary embodiments, the interferometer may monitor the optical signals every 5 or 10 mm, but other sampling schemes may be used in other exemplary embodiments.

Surface topography data of the raw substrate is thereby generated using the information obtained by scanning the substrate during the polishing process. Two or three dimensional wafer maps may be generated showing the spatial relationship of the relative high and relative low areas of the raw substrate. In one exemplary embodiment, pass/fail criteria for acceptable surface topography variations may be inputted into and stored by the detecting/monitoring system or an electronic circuit associated with the detecting/monitoring system, and the surface topography data compared to the pass/fail criteria. In another exemplary embodiment, the raw substrate topography profile may be compared to various other parameters and device characteristics which may vary across the surface of the substrate. From such a comparison, it may be determined that the undulations of the substrate surface correlate to the variations in the parameters and device characteristics. This detecting and monitoring may advantageously be carried out during the polishing process and as such, in-line monitoring of the substrates is achieved. Alternatively, such comparative data may direct one to other root causes of the various problems and anomalies. In response, various process controls and processing changes may be instituted to correct the cause of the problem or variation.

Figure 9:
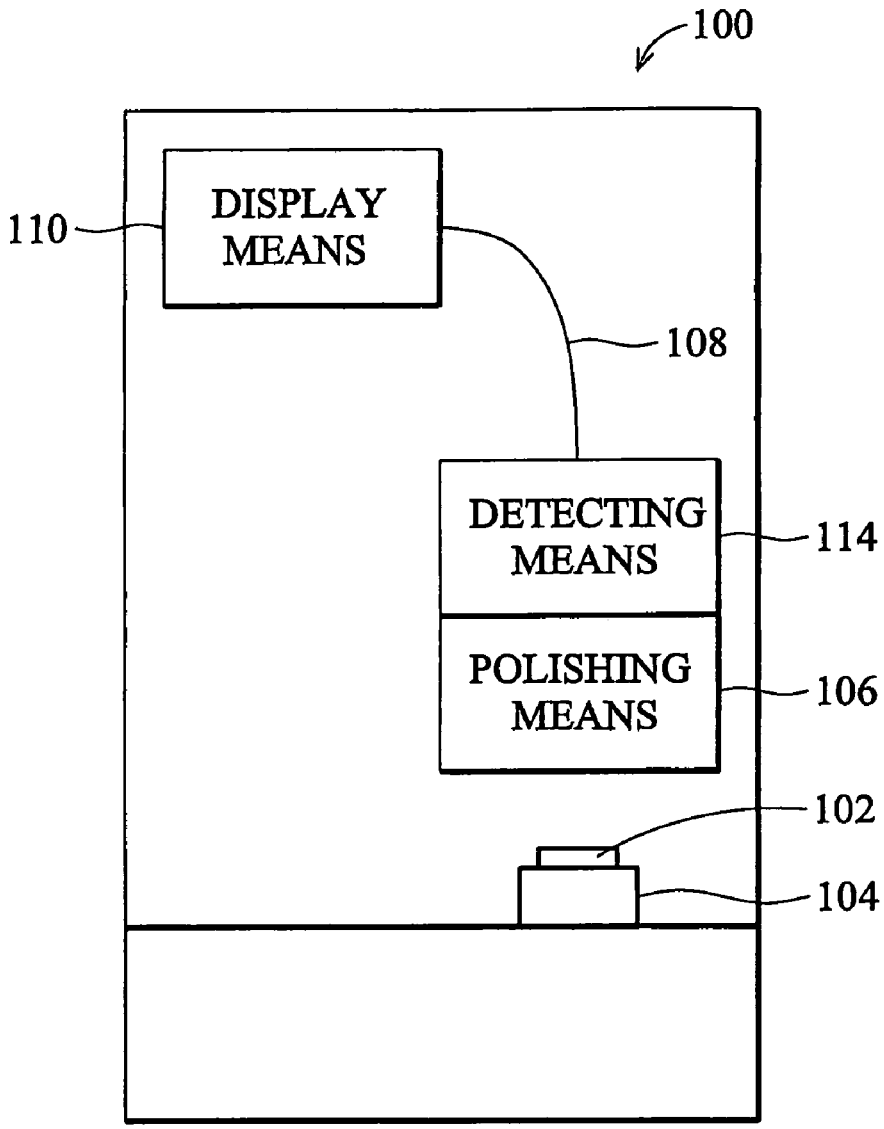
FIG. 9 is a schematic view of an exemplary in-line monitoring apparatus.

The present invention also provides an apparatus for carrying out the method described above. The apparatus may be used for in-line monitoring of substrates and is shown in FIG. 9. Apparatus 100 includes polishing means 106 such as a CMP apparatus and further includes a body 104 which may be a chuck, that receives substrate 102 to be polished. The apparatus also includes detecting means 114 that detect the presence or absence of a metal or reflective film, as opposed to a non-metallic or non-reflective film. As described above, detecting means 114 may be an optical device such as an interferometer and can read various locations across the substrate surface several times during the polishing operation. The apparatus further includes display means 110 such as a two-dimensional wafer profile such as shown in FIGS. 1A or 1B, or a three-dimensional wafer map such as shown in FIG. 2. Various other suitable display means known in the art may be used in other embodiments. The apparatus may include electronic circuitry 108 that may receive and store pass/fail criteria and automatically indicates whether the displayed substrate profile or map, satisfies the pass/fail criteria.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method for mapping surface topography of a substrate comprising:

forming a non-metallic film over a metal-free substrate;

forming a single metal film over said non-metallic film, said metal film not being a refractory metal;

polishing to remove at least a portion of said metal film; and distinguishing first regions in which said metal film remains, from second regions in which said metal film has been removed and said non-metallic film is exposed, by directing a beam of an optical signal to scan across a top surface of said substrate at a plurality of locations and in a plurality of arcuately spaced directions.

2. The method as in claim 1, wherein said forming a non-metallic film over a substrate comprises forming a dielectric film over a semiconductor substrate.

3. The method as in claim 1, wherein said substrate includes at least one further film formed thereover, and said forming a non-metallic film comprises forming a dielectric film over said at least one further film.

4. The method as in claim 3, wherein said at least one further film includes a patterned polysilicon film and a polished interlevel dielectric film formed thereover.

5. The method as in claim 3, distinguishing and further comprising generating two-dimensional topographical data of a surface of said substrate.

6. The method as in claim 1, wherein said forming a metal film comprises forming a copper film.

7. The method as in claim 1, wherein said polishing comprises chemical mechanical polishing (CMP).

8. The method as in claim 1, wherein said distinguishing includes using an interferometer to monitor said optical signal.

9. The method as in claim 1, wherein said distinguishing is repeated periodically during said polishing.

10. The method as in claim 1, wherein said distinguishing comprises directing said beam to scan in a plurality of non-radial directions.

11. The method as in claim 1, wherein said distinguishing includes spatially distinguishing said first regions from said second regions a plurality of times during said polishing, and further comprising generating a three-dimensional topographical map of said substrate based on said distinguishing.

12. The method as in claim 1, wherein said distinguishing includes directing a plurality of said beams to said top surface of said substrate and using an interferometer to detect one of a return refracted signal and a return reflected signal.

13. The method as in claim 1, further comprising generating a map of substrate topography based on data obtained during said distinguishing.

14. The method as claim 13, further comprising instituting in-line process controls based on said map.

15. The method as in claim 13, wherein said first regions correspond to relatively depressed regions of said substrate and said second regions correspond to relatively raised regions of said substrate.

16. The method as in claim 12, wherein said substrate is generally round and includes a diameter of about 12 inches and said distinguishing includes monitoring said optical signal at a plurality of locations, each of said plurality of locations separated from other of said plurality of locations by about 10–20 mm.

17. The method as in claim 1, wherein said substrate comprises a semiconductor substrate upon which a plurality of semiconductor devices are being formed, and said distinguishing includes directing said beam to scan along a plurality of scribe lines between respective semiconductor devices of said plurality of semiconductor devices on said semiconductor substrate.

18. A method for mapping surface topography of a substrate comprising:

forming a non-reflective film over a metal-free substrate;

forming a single reflective film over said non-reflective film, said reflective film not being a refractory metal;

polishing to remove at least a portion of said reflective film; and distinguishing first regions in which said reflective film remains, from second regions in which said reflective film has been removed and said non-reflective film is exposed by scanning a plurality of beams of an optical signal across a top surface of said substrate at a plurality of locations and in a plurality of arcuately spaced directions.

19. An apparatus for in-line monitoring of surface topography of a substrate comprising:

a body for receiving a substrate thereon;

polishing means for polishing a surface of said substrate;

means for scanning a plurality of beams of an optical signal across a top surface of said substrate at a plurality of locations and in a plurality of different directions; and detecting means for detecting a presence or absence of any reflective material at a plurality of arcuately spaced, non-linear locations of said substrate.

20. The apparatus as in claim 19, wherein said detecting means comprise an interferometer.

21. The apparatus as in claim 19, wherein said polishing means comprise a chemical mechanical polishing apparatus.

22. The apparatus as in claim 19, wherein said detecting means detects several times during a polishing operation.

23. The apparatus as in claim 19, further comprising display means that provide an output indicative of topography of said substrate.

24. The apparatus as in claim 23, in which said display means is coupled to electronic circuitry that compares said output to pass/fail criteria.

* * * * *

UNITED STATES PATENT AND TRADEMARK OFFICE

CERTIFICATE OF CORRECTION

PATENT NO. : 7,091,053 B2
APPLICATION NO. : 10/810533
DATED : August 15, 2006
INVENTOR(S) : Wan-Cheng Yang It is certified that error appears in the above-identified patent and that said Letters Patent is hereby corrected as shown below:

Column 7, line 23 of claim 5, “distinguishing and” should be deleted.

Signed and Sealed this

Tenth Day of April, 2007

JON W. DUDAS
*Director of the United States Patent and Trademark Office*